United States Patent [19]

DuBrow et al.

[11] 3,957,595

[45] May 18, 1976

[54] ZINC ELECTROPLATING

[75] Inventors: Paul DuBrow, Chicago; Moneeb Zakaria, LaGrange, both of Ill.

[73] Assignee: Nalco Chemical Company, Oak Brook, Ill.

[22] Filed: Jan. 10, 1975

[21] Appl. No.: 540,198

[52] U.S. Cl. ..... 204/55 R

[51] Int. Cl.[2] ..... C25D 3/22

[58] Field of Search ..... 204/55 R, 55 Y, 43 Z, 204/44, 114

[56] References Cited

UNITED STATES PATENTS

| | | | |
|---|---|---|---|
| 2,315,802 | 4/1943 | Lind et al. | 204/49 |
| 3,318,787 | 5/1967 | Rindt et al. | 204/55 Y |
| 3,824,158 | 7/1974 | Rosenberg | 204/55 R |
| 3,853,718 | 12/1974 | Creutz | 204/55 R |
| 3,869,358 | 3/1975 | Nobel et al. | 204/55 Y |
| 3,871,974 | 3/1975 | Duchene et al. | 204/55 R |

*Primary Examiner*—G. L. Kaplan

*Attorney, Agent, or Firm*—John G. Premo; Edward A. Ptacek

[57] ABSTRACT

An improved method of electroplating zinc comprises adding a polyquaternary ammonium salt or a mixture of a polyquaternary ammonium salt and a monomeric quaternary salt to the plating solution to improve the throwing power.

2 Claims, No Drawings

ZINC ELECTROPLATING

Electroplating is the electrodeposition of an adherent metallic coating upon an electrode for the purpose of securing a surface with properties or dimensions different from those of the basic metal. Most of the early uses of electroplating were predominantly decorative, and the physical and chemical properties of the product were not as important as its appearance. Electroplating has subsequently developed to depend on basic science and engineering.

Since electroplating is a surface treatment, it has for its purpose the alteration of the surface properties of the work being treated, which is made of the cathode in an electroplating solution or "bath". Such baths are almost always aqueous solutions, so that the metals which can be deposited are limited to those which are capable of being discharged from aqueous solutions, of their application. Beneficial properties conferred by electroplating include improved corrosion resistance, better appearance, wear resistance and hardness, solderability, specific electrical properties, improved frictional characteristics and many others.

Almost without exception, plating solutions are aqueous. Many ingredients are added to the solutions for various improvements. For example, two improvements are throwing power and brightness. Throwing power is needed because current density varies. Most solutions exhibit a range of current densities within which deposits are satisfactory and outside of which they are not; for bright plating solutions, this is called the bright range.

Since the current density over the electrodes will vary from point to point, in general, the areas on the cathode nearest to the anode will receive a higher current density than those more remote. Thus, more metal will be plated on the projections than in the recesses. Many plating solutions, however, have the ability to ameliorate this condition to some degree, and "throwing power" may be defined as the improvement in metal distribution over primary current distribution on a cathode. Plating solutions may be categorized as having excellent, good, poor or negative throwing power of a plating solution.

For decorative purposes, a bright appearance is needed. This bright appearance is produced by the addition to the plating bath of small amounts of one or more addition agents or brighteners. An improved brightener is also needed.

Formerly, cyanide baths were commonly used as plating solutions. But since cyanide is a severe pollutant, a substitute solution is needed. Therefore, a non-cyanide plating solution is needed using an additive having good throwing power.

OBJECTS

It is an object of this invention to improve electroplating. It is a further object to provide a non-cyanide plating solution. It is another object of this invention to improve the throwing power of a plating solution. Further objects will appear evident to those skilled in the art.

THE INVENTION

This invention pertains to improvements in the electrodeposition of zinc from aqueous alkaline zinc plating bath. These improvements are achieved by adding a polyquaternary ammonium salt or a mixture of a polyquaternary ammonium salt and a monomeric quaternary ammonium salt. Usually, the polyquaternary ammonium salt or mixture is added in a range from 0.05 to 3.0% by weight, based on the plating solution. A preferred range is from 0.10 to 1.0% by weight.

Polyquaternary ammonium salts and their preparations are well known to those skilled in the art. Preferably, the polyquaternary ammonium salt is formed by the reaction of methyl chloride with polyethylenepolyamine. The reaction is usually conducted in an aqueous alkaline solution. The ratio of polyethlenepolyamine to methyl chloride varies from 4:1 to 1:1 and preferably is 2:1. The polyethylenepolyamine is prepared by reacting ammonia with ethylene dichloride. The ratio of ethylene dichloride to ammonia usually varies from 6:1 to 2:1 and preferably is 4:1.

Monomeric quaternary ammonium salts are also well known. The monomeric quaternary ammonium salts which are useful in the practice of the invention have the following structural formula:

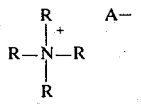

In the above formula, R is a hydrocarbon which contains between 1–22 carbon atoms. A is an anion of an inorganic acid. Preferably, A is a halide or sulfate.

In a preferred group of compounds falling within the above structural formula, 1 or 2 occurrences of R are fatty radicals which contain from between 6–22 carbon atoms in an aliphatic hydrocarbon or substituted aliphatic hydrocarbon chain. When 1 or 2 occurrences of R are fatty groups, they preferably contain between 12–18 carbon atoms. In certain instances, the fatty groups may contain mixed hydrocarbon groups of the type commonly found in animal fats and vegetable oils.

Illustrative of compounds of the above type useful in the practice of this invention are trimethylsoyammonium chloride. Additional compounds that may be used are dimethyl benzyl tallow ammonium sulfate, diethyl methyl oleoyl ammonium bromide and didodecyl-dimethyl ammonium chloride. Preferably, the monomeric quaternary ammonium salt is trimethylsoyammonium chloride.

The mixture of polyquaternary ammonium salt and monomeric quaternary ammonium salt can vary from 4:1 to 1:4 and preferably is in an equal ratio of 1:1. The mixture has been found to be even more effective in the plating solution than the polyquaternary ammonium salt by itself.

EXAMPLE 1

The preferred polyquaternary ammonium salt useful in this invention is the reaction product of methyl chloride and polyethylenepolyamine. The methods for preparing these polyquaternary ammonium salts are well known to those skilled in the art. Typically, the polyethylenepolyamine is formed by the reaction of ammonia and ethylene diamine under conditions of elevated temperatures and pressures. Ethylene dichloride is added into a pressurized system and anhydrous ammonia is continuously injected at a temperature in the range of 100°–150°C and at pressures of 25–75 psi. The pressure in the reaction vessel increases as the reaction proceeds. The ratio of ethylene dichloride to anhydrous ammonia is generally between 6:1 to 2:1 depending upon the other reaction conditions and the molecular weight of the amine that is desired. The preferred ratio of ethylene dichloride to anhydrous ammonia is 4:1. After the reaction reaches completion, usually 1–4 hours, the polyethylenepolyamine is reacted with methyl chloride in a concentration ratio of 4:1 to 1:1 with the preferred ratio being 2:1. This reaction is performed in an aqueous alkaline media. Any alkaline solution may be used for this reaction, but the preferred is a sodium hydroxide solution. The concentration may vary within a wide range but is generally 20–60% based on amine. A small amount of catalyst is used to initiate this reaction. Any such catalyst which is well known to the art may be used, including organic and inorganic types. This reaction is run at an elevated temperature between 80°–150°C. The polyquaternary ammonium salt which is formed is thereby used in this liquid state.

To test the effectiveness of the invention, a Hull cell was used. The Hull cell has found almost universal acceptance in both the research and quality control laboratories. Practically every plating electrode can be controlled or evaluated to varying degrees by the use of the Hull cell.

The Hull cell was invented by R. O. Hull in 1935 and consisted of a trapezoidal shaped, rubber coated, steel cell. The anode is vertically placed along the vertical side of the trapazoidal shaped cell. The cathode is affixed in a diagonal position along the diagonal side of the cell opposite to the vertical anode. With the anode and cathode in such positions, a deposit can be obtained on a flat cathode surface, which will closely parallel the nature of the deposit produced at both the operable current densities, and the extreme limiting current densities of the given plating bath. The volumes of the commonly used cells are 267, 534 and 1000 ml.

The actual current densities present on the cathode surface will depend upon the total amperage applied across the cell. The choice of cell amperage will vary from case to case depending upon the cell variables such as the type and size of the electrode and the current densities normally employed in production. The amperage should be selected so that the average current density used in the production bath falls between the middle and lower ⅓ of the cathode.

There are several commonly employed cathode surfaces used in the Hull cell including polished steel, chrome-plated steel, zinc plated steel, plastic coated brass and polished brass. These cathode surfaces are commercially available. A preferred cathode surface is chrome-plated steel.

The cathode surface must be treated prior to its use in the Hull cell. In the case of a steel surface, it must be cleaned in a 20% hydrochloric acid solution and rinsed under cold running water and swabbed with a sponge or paper towel. The treated cathode surface is then ready to be placed in the cell. It is important that finger contact with the surface be avoided during this cleaning treatment. Methods for cleaning the brass type cathode surfaces are similar to that of the steel and are well known.

Hull cell anodes should be of the metal under test, except in gold or rhodium baths where platinized titanium gauze anodes are preferred, and in chromium where corrugated lead anodes are used. In the method of the present invention, a zinc anode is used. These anodes are commercially available and require no cleaning treatment prior to use.

Many modifications of the cell, including thermostatically controlled heated cells and agitation units are available for sophisticated quality control operations. These are especially useful for elevated temperature electrolysis.

A typical test procedure for the Hull cell is as follows:

1. Obtain a representative sample of the solution under test;
2. Place anode in cell;
3. Fill cell to operating level with solution under test;
4. Check solution temperature and adjust to duplicate operating bath; when available, solution may be heated in thermostatically controlled cell, otherwise bring to operating temperature in a beaker prior to testing chrome plated steel;
5. Clean cathode surface by the procedure described above;
6. Place cathode surface in cell; turn on current and plate for the required time;
7. Shut off current; remove cathode surface, rinse and dry;
8. Save test surface or record results;
9. Repeat testing procedure after making addition of salts or additives to the bath.

An alkaline zinc bath was prepared using 8 g/l. of zinc oxide and 80 g/l. of sodium hydroxide. The bath as used in the conventional Hull cell (267 ml.) described above, at a temperature of 75°–80°F using a current of 2 amperes and a plating time of 5 minutes. The anode was zinc and the cathode, chrome plated steel. The appearance of each panel plated is described in the following table:

TABLE I

| | | DESCRIPTION* | | | | | |
|---|---|---|---|---|---|---|---|
| Panel No. | Bath Additives | Powder | Dark Grey | Streaked | Dull | Semi-Bright | Bright |
| 1 | None | L,M,H | L,M,H | L,M | | | |
| 2 | 0.1% Example 1 | | L,M,H | | L,M,H | | |
| 3 | 0.2% Example 1 | | | | L,M,H | | |
| 4 | 0.4% Example 1 | | | | L,M,H | | |
| 5 | 0.8% Example 1 | | | | L,M,H | | |
| 6 | 0.2% + 0.5 oz/gal. aluminum sulfate | | | H | L,M,H | L | |
| 7 | 0.15 oz/gal. thiourea | L,M,H | L,M,H | L | | | |
| 8 | 0.2% Example 1 + .15 oz/gal. thiourea | | | | L,M,H | | |
| 9 | 0.05 oz/gal. polyvinyl alcohol | L,M,H | L,M,H | L,M | | | |
| 10 | 0.05 oz/gal. polyvinyl alcohol + 0.2% Example 1 | | | | L,M,H | | |
| 11 | 0.075% Benzaldehyde | L,M,H | L,M,H | L | | | |
| 12 | 0.075% Benzaldehyde + 0.2% Example 1 | | | | | L,M,H | |
| 13 | 0.1 oz/gal. polyvinyl alcohol + | | | | L,M,H | | |

TABLE I-continued

| Panel No. | Bath Additives | DESCRIPTION* Powder | Dark Grey | Streaked | Dull | Semi-Bright | Bright |
|---|---|---|---|---|---|---|---|
| | 0.075% Benzaldehyde + 0.2% Example 1 | | | | | | |
| 14 | 0.1 oz/gal. Armohib 28** + 0.2% Example 1 | | | | L,M,H | | |
| 15 | 0.15 oz/gal. Diethylene thiourea | L,M,H | L,M,H | | | | |
| 16 | 0.15 oz/gal. Diethylene thiourea + 0.2% Example 1 | | | | L,M,H | | |
| 17 | 0.1% Allied Kelite Isobrite 380*** | L,M,H | L,M,H | L | L | | |
| 18 | 0.1% Allied Kelite Isobrite 380 + 0.2% Example 1 | | | | L,M,H | L,M,H | L,M,H |

L = Low Current Density 0–10 amperes square foot
M = Medium Current Density 10–40 amperes square foot
H = High Current Density 40–up amperes square foot
*The description means after a bright dip for 5 seconds in 0.5% nitric acid.
**Armohib 28 is a corrosion inhibitor commonly used in plating baths and readily available from Armour Chemical Company.
***Allied Kelite Isobrite 380 is a brightener available from Allied Chemical Company The above table shows the results of various dosages of the polyquaternary ammonium chloride prepared according to Example 1. This additive was tested alone and also with the various corrosion inhibitors, brighteners and other additives listed in Table I.

Another problem that often develops with additives in plating solutions is that the additive often prevents the metal from precipitating in a treatment system. Usually, the additive forms a complex with the zinc. In order to test the zinc concentration in the supernatant, the following procedure was used. A control zinc plating solution (8 g/l. zinc oxide and 80 g/l. sodium hydroxide) was diluted until the zinc concentration was approximately 500 ppm. A second and third identical solution with the addition of 0.2% benzaldehyde, respectively, were similarly diluted. The pH of each solution was adjusted to 9.5 using a pH meter.

After 17 hours settling time, the clear supernatant liquid was tested for zinc content using an atomic absorption unit. The results are listed below:

TABLE II

| Solution | Zinc Concentration (ppm) |
|---|---|
| 1 | 1.8 |
| 2 | 3.0 |
| 3 | 2.8 |

It can readily be seen that the additive of the polyquaternary ammonium chloride does not greatly prevent the precipitation of zinc in the system. Other additives would have increased the concentration of zinc in the supernatant to 200 ppm or more.

Further tests have shown that the addition of a mixture of the polyquaternary ammonium chloride and trimethylsoyammonium chloride are even more effective. The ratio of 1:1 is preferred. Using this ratio, the mixture was tested as in Table I alone, as well as with corrosion inhibitors, brighteners and other additives. This mixture achieved even better results than using the polyquaternary ammonium chloride by itself.

What is claimed and desired to be protected by Letters Patent is:

1. An improved method of zinc electroplating a base metal which comprises: adding from 0.05 to 3.0% by weight of a polyquaternary ammonium salt which is the reaction product of methyl chloride and polyethylenepolyamine which is formed by the reaction of ammonia and ethylene dichloride, with the ratio of ethylene dichloride to ammonia ranging from 6:1 to 2:1, to an aqueous alkaline zinc plating bath, and then electroplating the base metal to place a zinc coating on the base metal.

2. The method of claim 1 wherein the amount of the polyquaternary ammonium salt ranges from 0.10 to 1.0% by weight.

* * * * *